United States Patent [19]

Marshino

[11] 4,041,692

[45] Aug. 16, 1977

[54] ELECTRONIC CLOCK HAVING TIME INDICATING LIGHT DISPLAY

[75] Inventor: James B. Marshino, Goodland, Ind.

[73] Assignee: Amelect Incorporated, Goodland, Ind.

[21] Appl. No.: 647,382

[22] Filed: Jan. 8, 1976

[51] Int. Cl.[2] ..... G04B 19/34; G04C 3/00

[52] U.S. Cl. ..... 58/50 R; 58/127 R

[58] Field of Search ..... 58/23 R, 50 R, 126 R, 58/127 R, 128, 129

[56] References Cited

U.S. PATENT DOCUMENTS

| | | | |
|---|---|---|---|
| 1,096,778 | 5/1914 | Clement | 58/50 R |
| 3,456,152 | 7/1969 | Andersen | 58/50 R X |
| 3,540,209 | 11/1970 | Zatsky et al. | 58/50 R |
| 3,772,874 | 11/1973 | Lefkowitz | 58/50 R |
| 3,958,409 | 5/1976 | Manber | 58/50 R |

*Primary Examiner*—Stanley J. Witkowski
*Attorney, Agent, or Firm*—John R. Nesbitt

[57] ABSTRACT

An electronic clock is disclosed having a time indicating light display on the clock face with the light display being provided by a plurality of light emitting diodes positioned to form three spaced concentric rings for separately indicating time in seconds, minutes and hours. An input signal having a frequency of 60 hertz is frequency divided to provide a signal having a frequency of one hertz that is coupled to a seconds decoder connected to a first 6×10 LED matrix. One pulse per minute is provided from the seconds decoder to a minutes decoder that is connected to a second 6×10 LED matrix, and one pulse per hour is provided from the minutes decoder to an hours decoder that is connected with a 1×12 LED matrix. Each of the outer and middle concentric rings at the clock face includes 60 LEDs while the inner ring includes 12 LEDs with energization of an LED in the inner ring indicating the hour, energization of an LED in the middle ring indicating the minute, and energization of an LED in the outer ring indicating the second. The decoders utilize multistage Johnson counters which enable the use of the needed LED matrix, and circuitry is also provided for holding the second indication while advancing the minute and hour indications for setting the clock. A light simulated pendulum is provided for the electronic clock by successive energization of a plurality of LEDs positioned in an arc. For pendulum simulation, a multiplexer receiving the outputs from a counter is connected with a 1×10 LED matrix.

16 Claims, 8 Drawing Figures

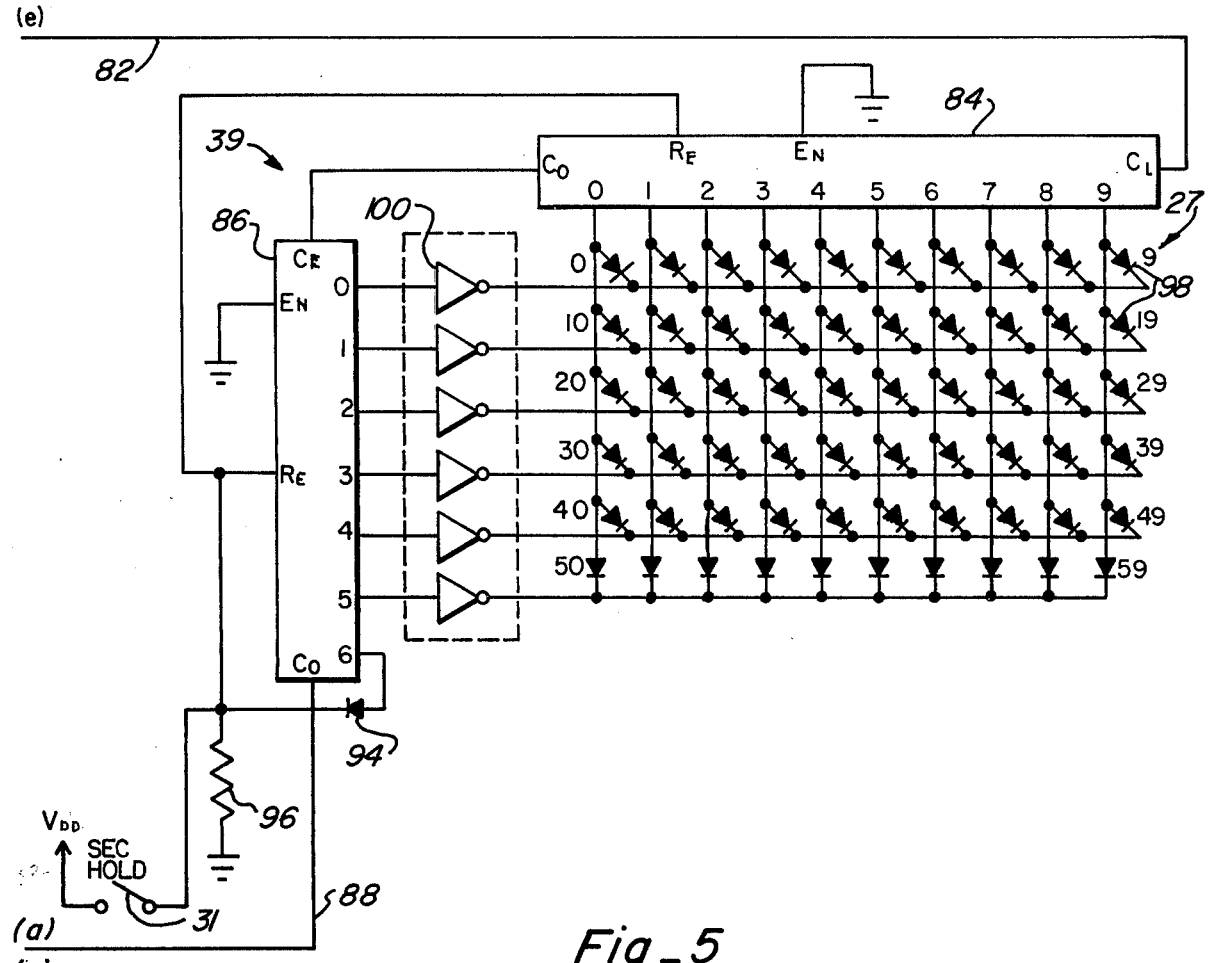
Fig_5
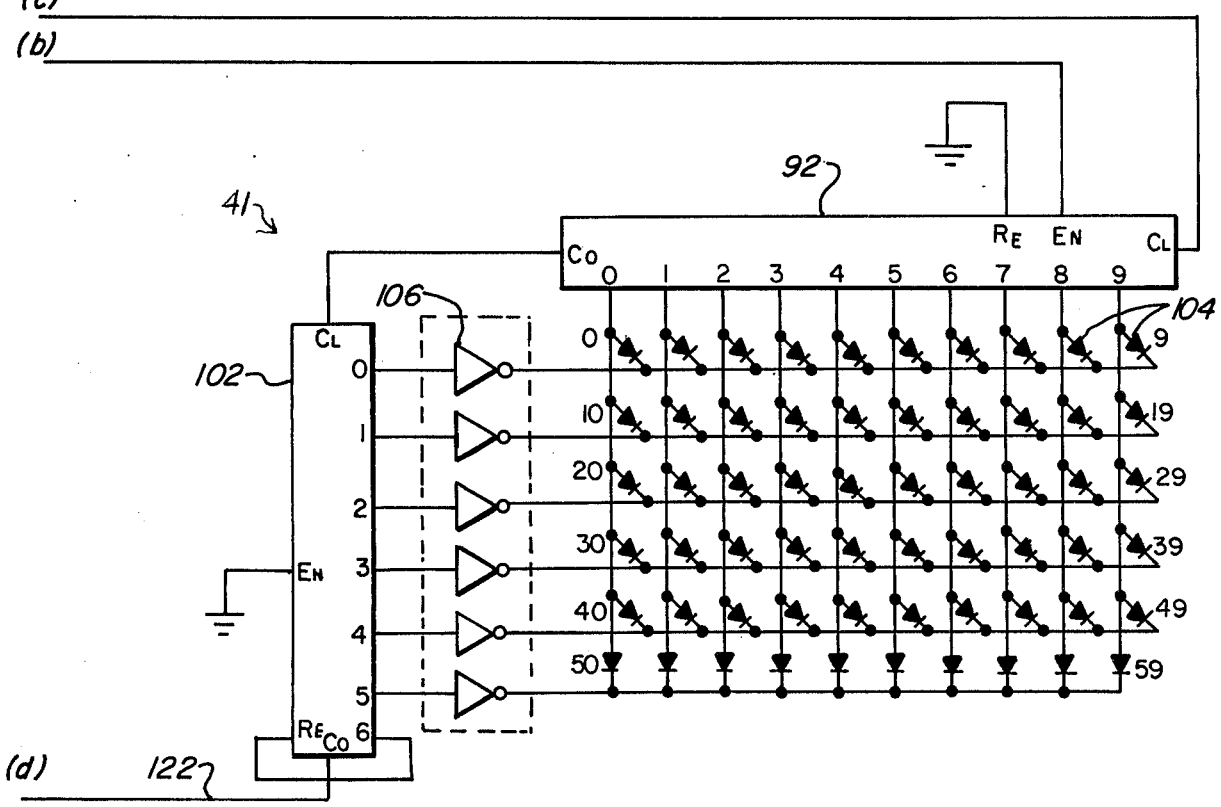

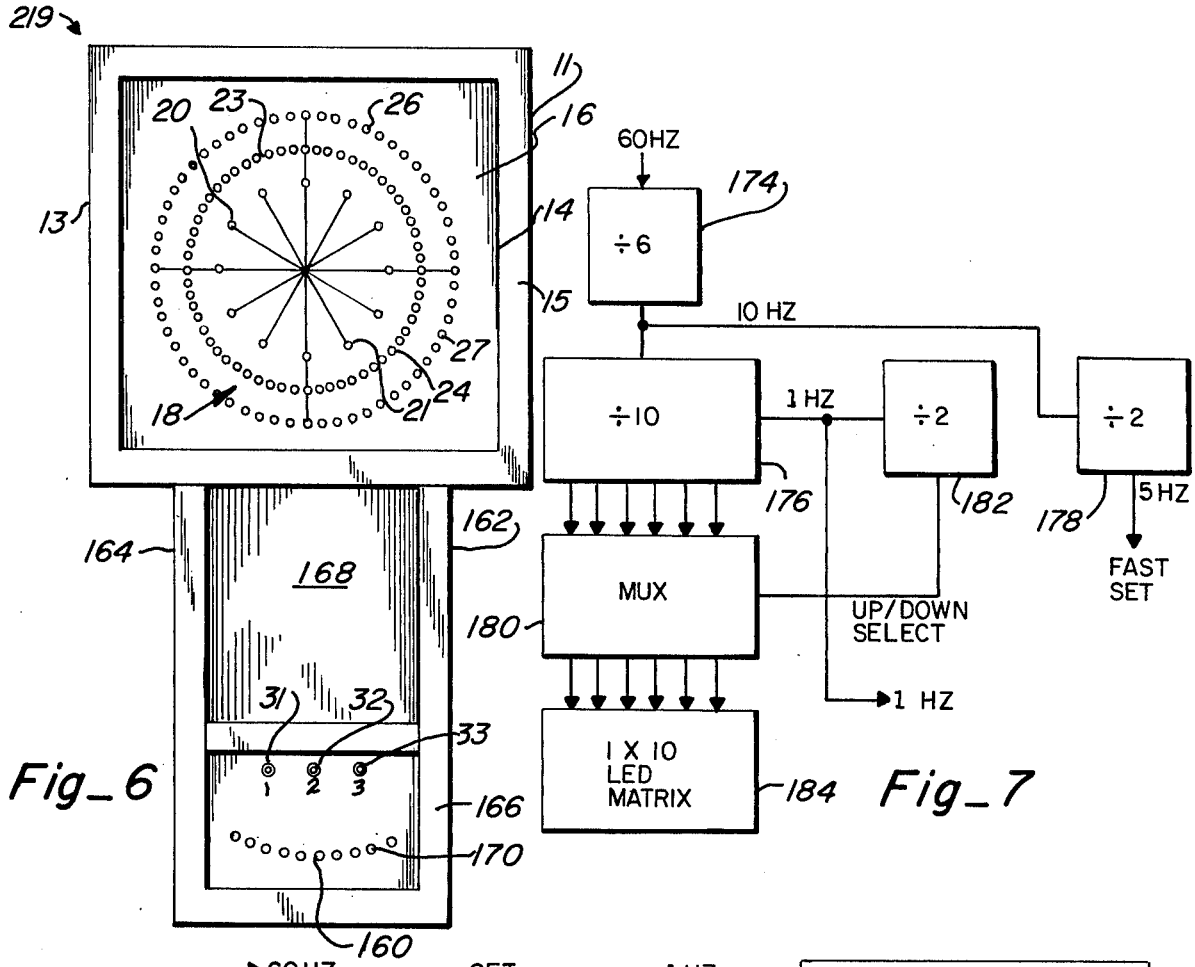
Fig_6
Fig_7
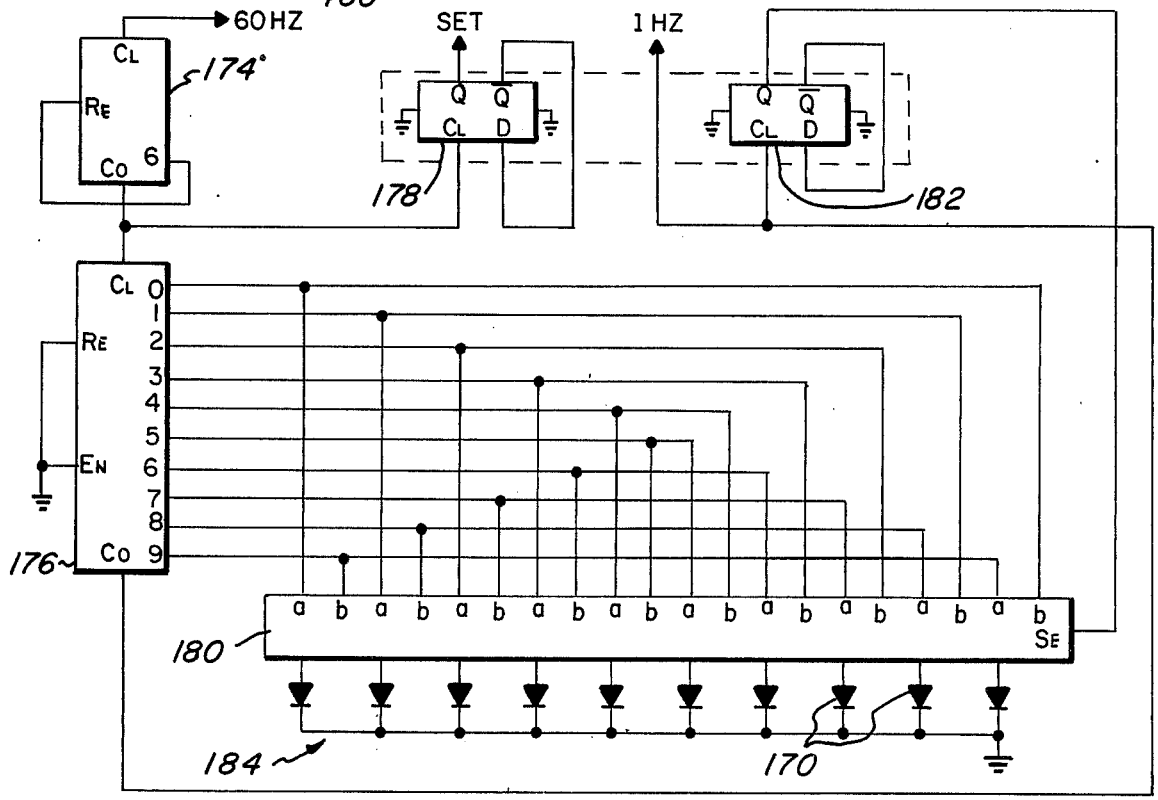
Fig_8

ELECTRONIC CLOCK HAVING TIME INDICATING LIGHT DISPLAY

FIELD OF THE INVENTION

This invention relates to an electronic clock and, more particularly, relates to a clock having a time indicating light display.

BACKGROUND OF THE INVENTION

Time indicating devices are well known, with time being commonly indicated by the positioning of long and short hands that rotate around a clock face having indicia thereon such as sixty marks spaced essentially in an annular ring concentric with the axis of the clock hands with each fifth mark being indicated by the numerals one through twelve.

Many variations of clocks have heretofore been suggested and/or utilized, including lighting of the clock face, time indicating markings, and/or clock hands, as well as electric and electronic clock circuitry. Such suggested variations are shown, for example, in U.S. Pat. Nos. 2,745,243; 3,258,906; 3,456,152; 3,540,209; 3,579,976; 3,593,517; 3,596,462; 3,754,392; 3,775,964; 3,823,549; and 3,844,105. In addition, such clocks have utilized rings of lights and digital logic circuitry (see, for example, U.S. Pat. Nos. 3,754,392 and 3,844,105), a simulated pendulum (see, for example, U.S. Pat. No. 2,995,005), and have utilized a 60 hertz input as well as stepping for clock setting (see, for example, U.S. Pat. No. 3,456,152).

While electronic clocks have heretofore been suggested with many variations being provided, the clock of this invention is an improved clock that is successful in providing an electronic clock that is capable of dependably providing an independent visual indication of the hour, minute and second by solid state circuitry that is relatively simple and economical, yet enables the use of each needed LED matrix.

SUMMARY OF THE INVENTION

This invention provides an improved solid state electronic clock having a time indicating light display provided by a plurality of LEDs positioned in three concentric rings to separately indicate hours, minutes and seconds. Multi-stage counters enable the use of a 6×10 LED matrix for the separate indication of minutes and seconds, while a 1×12 LED matrix indicates the hour. The circuitry utilizes a 60 hertz input and holds the second indication while enabling rapid advancement of the minute and hour indications for setting the clock. In addition, a light simulated pendulum may also be provided.

It is therefore an object of this invention to provide an improved electronic clock.

It is another object of this invention to provide an improved electronic clock having time indicating light display.

It is another object of this invention to provide an improved electronic clock having a plurality of LEDs positioned in three concentric rings each of which provides a different parameter of time for visual viewing at the face of the clock.

It is still another object of this invention to provide an improved electronic clock utilizing multi-stage counters to drive separate LED matrixes for visually indicating hours, minutes and seconds.

It is still another object of this invention to provide an improved electronic clock having separate 6×10 LED matrixes for indicating minutes and seconds and a 1×12 LED matrix for indicating hours.

It is yet another object of this invention to provide an improved electronic clock utilizing a sixty hertz input to digital logic circuitry.

It is still another object of this invention to provide an improved electronic clock having circuitry for holding the second display while rapidly advancing the hour and minute display in setting the clock.

It is yet another object of this invention to provide an improved electronic clock having a light simulated pendulum.

With these and other objects in view, which will become apparent to one skilled in the art as the description proceeds, this invention resides in the novel construction, combination, and arrangement of parts substantially as hereinafter described, and more particularly defined by the appended claims, it being understood that such changes in the precise embodiment of the hereindisclosed invention are meant to be included as come within the scope of the claims.

BRIEF DESCRIPTION OF THE DRAWINGS

The accompanying drawings illustrate two complete embodiments of the invention according to the best mode so far devised for the practical application of the principles thereof, and in which:

FIGS. 4 and 5 taken together form an electronic schematic diagram of the clock of this invention shown in block form in FIG. 3;

FIG. 6 is a front view of an alternate embodiment of an electronic clock having a light simulated pendulum;

FIG. 7 is a partial electronic block diagram of the clock of the invention shown in FIG. 5; and FIG. 8 is a partial electronic schematic diagram of the clock of the invention as shown in FIG. 6.

DESCRIPTION OF THE INVENTION

Figure 1:
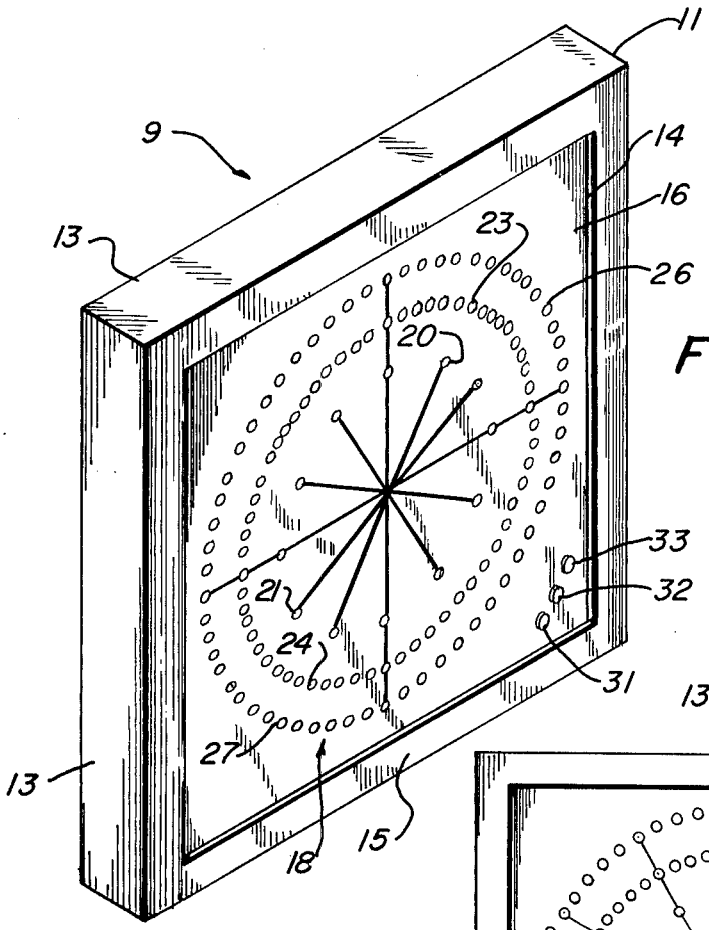
FIG. 1 is a perspective view of the electronic clock of this invention.
Figure 2:
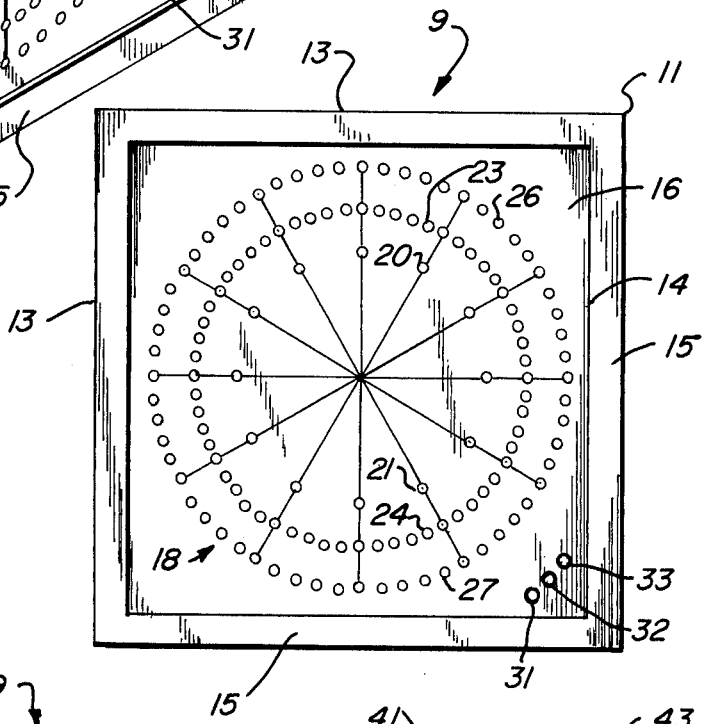
FIG. 2 is a front view of the face of the electronic clock shown in FIG. 1.

Referring now to the drawings, the electronic clock 9 of this invention is shown in FIGS. 1 and 2 to include a clock housing 11, which housing includes four sidewalls 13, a back wall (not shown) and a front face 14 which includes a frame portion 15 and a recessed portion 16 with the recessed portion having a time indicating light display 18 thereon. The housing could be of any suitable material, such as, for example, utilizing wood for the walls and frame with an acrylic recessed face portion.

Time indicating light display 18 includes a plurality of light emitting diodes (LEDs) formed into three concentric rings with the inner ring 20 including an LED matrix 21 (which includes 12 LEDs) to indicate the hour, middle ring 23 including an LED matrix 24 (which includes 60 LEDs) to indicate the minute, and outer ring 26 including an LED matrix 27 (which includes 60 LEDs) to indicate the second. Each matrix is connected to logic, or timing, circuitry 29 so that only one LED is energized at any one time in each of the three rings with each LED being successively energized in a clockwise direction in each ring so that successive energization of each of the LEDs in the outer ring takes one minute to indicate the lapse of 60 seconds, successive energization of each of the LEDs in the middle ring takes one hour to indicate the lapse of 60 minutes, and successive energization of each of the LEDs in the inner rings takes one-half day to indicate the lapse of 12 hours.

As also shown in FIGS. 1 and 2, set switches 31, 32 and 33 are provided at the face of the clock for setting the clock. Switch 31 is a second-hold switch, switch 32 is a minute-set switch, and switch 33 is an hour-set switch.

Figure 3:
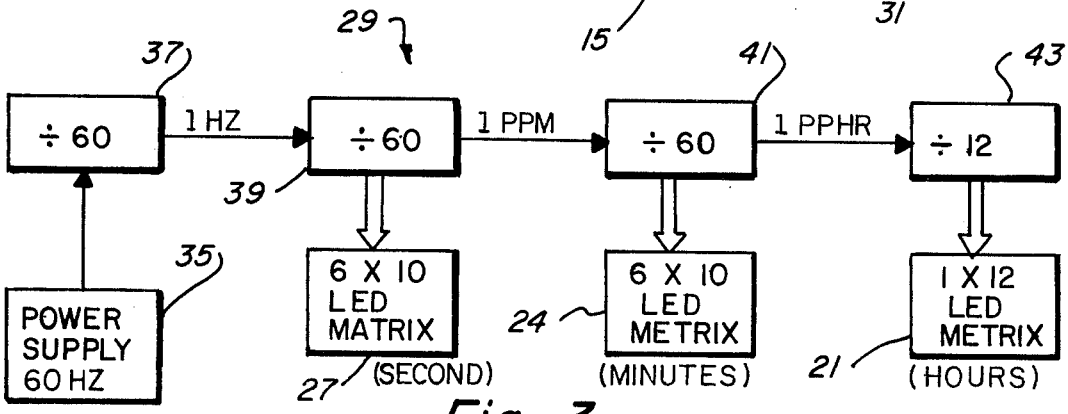
FIG. 3 is an electronic block diagram of the clock of this invention shown in FIGS. 1 and 2.

A block diagram of the electronic clock of this invention to illustrate the basic LED matrix control circuitry, or timing means, 29 is shown in FIG. 3. As shown, a power supply 35 providing an output at a frequency of 60 hertz (which can originate, for example, from the commercially available 110–120 volt, 60 hertz power source) provides a square wave input signal to a frequency divider 37 (a divide-by 60 circuit) the output of which provides a signal at a frequency of one hertz which signal is coupled to a second frequency divider 39 (also a divide-by-60 circuit) which controls operation of seconds LED matrix 27. A pulse per minute output is provided from divider 39 to a third frequency divider 41 (also a divide-by -60 circuit) which controls operation of minutes LED matrix 24. A pulse per hour output from divider 41 is provided to a four frequency divider 43 (a divide-by-12 circuit) which controls operation of hour LED matrix 21. As indicated, LED matrix 27 and LED matrix 24 are 6×10 LED matrixes while LED matrix 21 is a 1×12 LED matrix.

Figure 4:
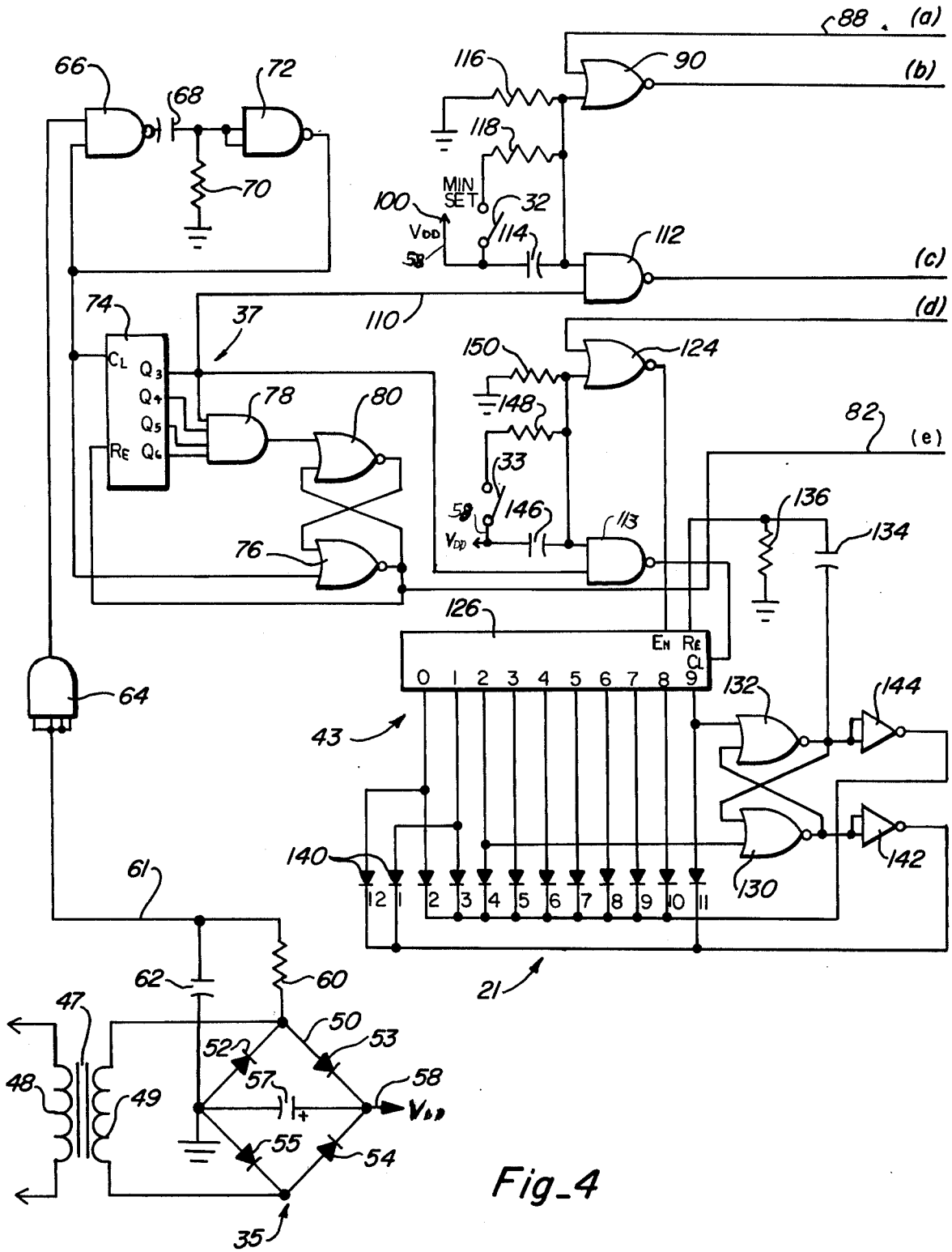

The circuitry of the electronic clock shown in basic block diagram in FIG. 3 is shown in more detail in FIGS. 4 and 5 which taken together form an electronic schematic diagram of one embodiment of the clock of this invention. As shown, step-down transformer 47 of power supply 35 has the primary winding 48 adapted to be connected to a conventional 110–120 volt, 60 hertz, power source, with the secondary winding 49 being connected to full wave bridge rectifier 50. Rectifier 50 includes four diodes 52–55 with the junction of diodes of 52 and 53 being connected to one side of secondary winding 49 of transformer 47, the junction of diodes 54 and 55 being connected to the other side of secondary winding 49 of transformer 47, the junction of diodes 52 and 55 being grounded, the junction of diodes 52 and 55 and the junction of diodes 53 and 54 having a capacitor 57 extending therebetween, an output ($V_{dd}$) being taken from the junction of diodes 53 and 54 on lead 58, and an output to divide-by-60 frequency divider 37 being coupled from the junction of diodes 52 and 53 through resistor 60 to lead 61 (lead 61 also having a by-pass capacitor 62 to ground connected therewith).

The output from rectifier 50 is filtered and buffered and, as shown in FIG. 4, to accomplish this end, lead 61 is connected through AND gate 64 to provide one input to NAND gate 66. The output from NAND gate 66 is coupled to one side of capacitor 68 the other side of which capacitor has a resistor 70 to ground, and is also connected to the inputs of NAND gate 72.

The output from NAND gate 72 is coupled back as a second input to NAND gate 66, the counter 74, and as one input to NOR gate 76. Counter 74 is a seven stage storage binary ripple counter with the outputs being coupled through AND gate 78 to the set input of NOR gate 80. NOR gates 76 and 80 are interconnected as a set-reset flip flop with the $\overline{Q}$ output therefrom being fed back to the reset of the counter 74 to yield the needed one hertz repetition rate. The $\overline{Q}$ output signal is also fed through lead 82 to the input of units counter 84 of the divide-by-60 frequency divider circuit 39, with the carryout of unit counter 84 being fed to tens counter 86 of divide-by-60 frequency divider circuit 39. Counters 84 and 86 are preferably five and three stage Johnson counters, respectively, and the carryout of the tens counter 86 has a repetition rate of one pulse per minute, which output is coupled on lead 88 through NOR gate 90 to the enable input of counter 92 of divide-by-60 frequency divider circuit 41.

As shown in FIG. 4, the reset inputs of counters 84 and 86 are connected in common to output 6 of tens counter 86 through diode 94 and second-hold switch 31 to bridge rectifier 50 in the power supply. When switch 31 is closed, the second indication is reset and held at zero. A resistor 96 to ground is connected with the reset inputs of counters 84 and 86.

Seconds LED matrix 27 includes 60 LEDs 98 as indicated in FIG. 5. As shown, each group of six LEDs in the matrix have their anodes connected with separate outputs from counter 84. As also shown, each group of ten LEDs (each of which is connected with a different output from counter 84) have their cathodes connected with separate outputs of counter 86 through NOT gates (inverters) 100. Due to the diode action of the LEDs, only one LED in each matrix can be energized at any one time as controlled by the counters. Thus, when the LEDs are positioned in a circle to form outer ring 20 on the clock face, each LED will be successively energized and the light therefrom will visually indicate the passage of each second of time. Thus, the control circuitry enables a 6×10 LED matrix to be utilized.

After 60 seconds, a pulse from counter 86 is coupled to counter 92 of the minutes divide-by-60 frequency divider circuit 41. Counter 92 is connected with counter 102 and these counters may be identical to counters 84 and 86. Counter 92 is connected to LEDs 104 in the same manner as LEDs 98 are connected to counter 84, and counter 102 is connected to LEDs 104 through NOT gate 106 in the same manner as counter 86 is connected to LEDs 98. As a result, the LEDs 104 are energized in the same manner and when positioned in a circle to form middle ring 23 on the clock face, each LED will be successively energized to indicate the passage of each minute of time. Here again, the control circuitry enables a 6×10 LED matrix to be utilized.

To set the minute indication, a fast set is provided. As shown, a fast set signal having a frequency of 2 hertz is coupled from the $Q_3$ output of counter 74 and coupled on lead 110 to one input of NAND gates 112 and 113.

The second input to NAND gate 112 is connected to one side of capacitor 114, to the second input of NOR gate 90, to ground through resistor 116, and to one side of minute-set switch 32 through resistor 118. The other side of capacitor 114 is connected to the power supply (i.e., bridge rectifier 50) and to the other side of switch 32. NAND gate 112 is connected to the input of counter 92 so that when switch 32 is closed, a fast set signal is provided to enable setting of the minute indicating circuitry of the clock.

The carryout output from counter 102 is coupled on lead 122 through NOR gate 124 to the enable input of counter 126 of divide-by-12 frequency divider circuit 43, and provides an output at a repetition rate of one pulse per hour.

Counter 126 is a five stage Johnson counter and is connected with a set-reset flip flop to provide the divide-by-12 function. As shown in FIG. 4, the 2 output of counter 126 is connected to an input (the set input of the flip flop) of NOR gate 130, while the 9 output of counter 126 is connected to one input (the reset input of the flip flop) of NOR gate 132. The output of NOR gate 132 (the Q output of the flip flop) is connected to a differentiating circuit that includes capacitor 134 and resistor 136, with the output of the differentiater being coupled to the reset input of counter 126. This causes an input to reset the counter at the same time that a rising pulse edge occurs at the counter 2 output to reset the counter back to zero and change the flip flop to the set state. With counter 126 in the set state, the counter will count through the entire cycle of zero through nine without a reset. On the ninth count, the flip flop is set back to the original state and the counter will count to two, at which time the 2 output sets the flip flop and resets the counter thus providing the needed frequency division by 12.

The outputs from 126 are connected to LEDs 140 of hour LED matrix 21. With the LEDs positioned into a circle to provide inner ring 26 on the clock face, the LED energized will indicate the hour and the LEDs will be successively energized to indicate each hour of a one-half day. As shown, the anodes of the LEDs 140 are connected to the outputs from counter 126 while the cathodes of LEDs 140 are connected to the Q or $\overline{Q}$ outputs from the flip flop. More particularly, the cathodes of LEDs 140 identified as 1, 11 and 12 are connected to the output of NOR gate 130 through NOT gate 142 while the remainder of the cathodes are connected to the output from NOT gate 144.

For setting of the hour indication, hour-set switch 33 and the lead to the power supply (i.e., to bridge rectifier 50) are connected to one side of capacitor 146 with the other side of capacitor 146 being connected to the second input from NOR gates 113 and 124 to the other side of switch 33 through resistor 148, and to ground through resistor 150.

An alternate embodiment 219 of the electronic clock of this invention is shown in FIGS. 6 through 8 to include a light simulated pendulum 160.

As shown in FIG. 6, the clock housing and face can be the same as for the clock of FIG. 1 (although the clock of FIG. 1 may be turned to provide a diamond effect rather than a square or rectangular effect, which orientation, of course, depends upon the location of the numerals providing the indicia of time of the face of the clock). To provide a housing for the light simulated pendulum, a housing extension 162 is provided and may also be provided by wood sides 164 and a wood frame 166 with the face formed of any suitable material such as, for example, by an acrylic panel 168 that may be recessed, if desired. Switches 31-33 may be placed in the housing extension, as indicated in FIG. 6.

As also indicated in FIG. 6, pendulum 160 is formed by a plurality of LEDs 170 (such as shown in FIG. 6) that are successively energized to give a visual effect of a pendulum swinging back and forth. Thus, a "grandfather" clock is provided utilizing the embodiment of the invention shown in FIG. 6.

For implementing the electronic clock having a light simulated pendulum, it is necessary, as shown in FIG. 3, to replace the divide-by-60 frequency divider circuit 39 with the circuitry as shown in the block description of FIG. 7 and the electronic schematic of FIG. 8. As shown, the input signal having a frequency of 60 hertz is coupled to a divide-by-6 frequency divider circuit 174 which provides an output at a frequency of 10 hertz that is coupled to a divide-by-10 frequency divider circuit 176 and a divide-by-2 frequency divider circuit 178.

Divide-by-10 frequency divider circuit 176 includes a five stage Johnson counter with the ten decimal outputs fed to a decimal two input multiplexer 180 so that the outputs of the multiplexer 180 count up zero through nine and down nine through zero depending on the level of the select input.

Thus the output from the divide-by-2 circuit 178 provides a five hertz output signal for setting the clock (in the same manner as provided hereinabove with respect to the minutes and hours) while the divide-by-10 circuit 176 provides outputs to a multiplexer circuit 180. The divide-by-10 circuit 176 also provides a one hertz output to a divide-by-2 circuit 182 which is connected with multiplexer 180 to form an up-down select. The one hertz output from the divide-by-10 circuit 176 is coupled to the divide-by-60 circuit 39 for the time indications as described in connection with FIGS. 1 through 5.

Divide-by-2 circuits 178 and 182 are preferably "D" type flip flops with $\overline{Q}$ output connected to the data input to divide the input frequency by two. The Q output of divide-by-2 circuit 182 is fed to the up-down select input of the decimal two input multiplexer 180 to thereby select the count "up" or "down" mode at a one-half hertz repetition rate. The Q output of the divide-by-2 frequency divider circuit 178 is fed to the fast set input of the clock with a repetitive rate of 5 hertz.

Multiplexer 180 is connected with a $1 \times 10$ LED matrix 184 that forms the simulated pendulum 160. As shown, the cathodes of LEDs 170 are connected to ground. The LEDs 170 are preferably positioned in an arc to simulate the swinging in opposite directions of a pendulum as controlled by the outputs of the multiplexer 180 counting zero through 9 and from 9 through zero.

While not meant to be limited thereto and by way of illustration only, working embodiments of the electronic clock of this invention have utilized the following:

LED matrixes 21, 24 and 27 — 5082-4494; 184 — 5082-7794
AND gates 64 and 78 —4082
NAND gates 66, 72, 112, and 114 — 4011
NOR gates 76, 80, 90, 124, 130 and 132 —4001
NOT gates 100 and 106 — 4069 142 and 144 — 4001
counters 74, 84, 86, 92, 102, 126, 174 and 176 — 4017
Flip Flop 178 and 182 — 4013
Multiplexer 180 — 74C157
Diodes 52, 53, 54, 55 and 94 — IN4148
Resistors 60—22K; 70—10K; 96—56K; 116—100K; 118—15K; 136—56K; 146—15K; and 150-100K
Capacitors 57—250 Mfd; 62—0.05 Mfd; 68—0.1 Mfd; 114—0.05 Mfd; 134—470 Pfd; and 146—0.05 Mfd.

In operation, the electronic clock is supplied with power from a conventional source (such as a conventional 110-120 volt 60 hertz source) and the clock is set by closing switches 31 through 33 to set the hour and minute indications while holding the second indication at zero. Upon opening of the switches, the clock will then automatically function by successively energizing an LED in each ring to indicate the time in hours, minutes and seconds. With a simulated pendulum provided, a swinging pendulum will be visually simulated by swinging back and forth in an arc. While not specifically shown, it is to be realized that an indication of the date and month could also be provided by extension of the digital logic circuitry provided, if desired.

What is claimed is:

1. An electronic clock having a time indicating light display, said electronic clock comprising:

pulse generating means for producing output pulses at predetermined times;

decoding means connected with said pulse generating means to recieve said output pulses therefrom, said decoding means including a plurality of frequency dividers providing separate outputs indicative of time in hours, minutes and seconds; and matrix means including a plurality of matrixes two of which are 6×10 matrixes and the other of which is a 1×12 matrix, each of which matrixes is connected with a different one of said plurality of frequency dividers of said decoding means to receive therefrom said indications of time in hours, minutes and seconds, said matrix means including light means positioned in three separate segments each of which segments surrounds a point common to all of said segments, said light means being connected with said timing means for selective energization of a portion of each segment of said light means to thereby produce three separate light displays the energized portion of one such segment indicating time in hours, the energized portion of a second of which segments indicates time in minutes, and the energized portion of the third of which segments indicates time in seconds.

2. The electronic clock of claim 1 wherein said pulse generating means includes a divide-by-60 frequency divider adapted to receive an input signal from a conventional power supply providing an output signal having a frequency of 60 hertz to provide said output pulses at said predetermined times.

3. The electronic clock of claim 1 wherein said plurality of frequency dividers includes three dividers two of which are divide-by-60 dividers and the other which is a divide-by-12 divider.

4. The electronic clock of cliam 1 wherein said light means includes a plurality of light emitting diodes with said segments positioned into three concentric rings to indicate time in hours, minutes and seconds.

5. The electronic clock of claim 1 wherein said clock includes means for fast setting of said clock.

6. The electronic clock of claim 5 wherein said means to provide fast setting of said clock includes first means for resetting the indication of seconds to zero and second and third means for selectively causing fast setting of the time indications of the minute and hour.

7. The electronic clock of claim 1 wherein said clock is a solid state clock.

8. The electronic clock of claim 1 wherein said clock includes means for simulating a pendulum.

9. The electronic clock of claim 8 wherein said means for simulating a pendulum includes counter means connected with said pulse generating means, decoding means, and a light matrix to visually simulate a swinging pendulum.

10. An electonic clock having a time indicating light display, said electronic clock comprising:

pulse generating means for providing output pulses at predetermined times;

decoding means including three frequency dividers connected with said pulse generating means and controlled by said output pulses therefrom, the first of said frequency dividers including a pair of Johnson counters and providing an output indication of time in seconds, the second of said frequency dividers including a pair of Johnson counters and providing an output indication of time in minutes, and the third of said frequency dividers including a Johnson counter and providing an output indication of time in hours;

first and second light matrix means connected with said first and secondary dividers, said first and second matrix means being 6×10 matrixes including light emitting diodes to visually indicate time in minutes and seconds; and third matrix means connected with said third frequency divider, said third matrix means being a 1×12 matrix with light emitting diodes to visually indicate time in hours.

11. the electronic clock of claim 10 wherein said output pulses from said pulse generator is an output signal having a frequency of one hertz, wherein said first and second frequency dividers of said decoding means include a divide-by-60 divider, and wherein said third frequency divider of said timing means includes a divide-by-12 divider.

12. The electonic clock of claim 10 wherein said first, second and third matrixes are positioned into three separate substantially concentric rings with the outer ring indicating seconds, the middle indicating minutes and the inner ring indicating hours.

13. An electronic clock having a light display indicating time and a simulated pendulum, said electronic clock comprising:

pulse generating means for providing output pulses at predetermined times;

first decoding means connected with said pulse generating means to receive said output pulses therefrom, said first decoding means including a plurality of frequency dividers providing separate outputs including pulses at different frequencies with said pulses being indicative of time in hours, minutes and seconds.

a first light matrix connected with said first decoding means and responsive to said pulses at different frequencies therefrom indicating time in hours, minutes and seconds;

second decoding means connected with said pulse generating means to receive said output pulses therefrom, said second decoding means including a frequency divider for providing a preselected output that includes pulses at a predetermined lower frequency than are said pulses produced by said pulse generation means; and a second light matrix connected with said second decoding means and responsive to said pulses therefrom to visually indicate a simulated swinging pendulum.

14. The electronic clock of claim 13 wherein said second decoding means includes a multiplexer and wherein said second light matrix is a 1×10 light matrix connected with said multiplexer.

15. The electronic clock of claim 13 wherein said first and second matrixes include light emitting diodes.

16. The electronic clock of claim 13 wherein said second light matrix is positioned in an arc and wherein the lights of said second light matrix are successively energized to simulate said swinging pendulum.

* * * * *